United States Patent [19]

Gaylord et al.

[11] 4,356,870

[45] Nov. 2, 1982

[54] WATER SPRAY FIRE PROTECTION FOR HOODS OVER COOKING UNITS

[75] Inventors: Edson C. Gaylord, Wilsonville; David K. Black, Lake Oswego; Russell L. Anderson, Wilsonville; Philip O. Morton, Portland, all of Oreg.

[73] Assignee: Gaylord Industries, Inc., Wilsonville, Oreg.

[21] Appl. No.: 207,912

[22] Filed: Nov. 18, 1980

[51] Int. Cl.[3] ..... A62C 13/24

[52] U.S. Cl. ..... 169/65; 169/23; 126/299 R

[58] Field of Search ..... 169/65, 23, 20, 61, 169/19, 51, 5, 37, 16; 126/299 R, 299 D, 299 E, 42; 431/33; 98/115 R, 115 K

[56] References Cited

U.S. PATENT DOCUMENTS

| | | | |
|---|---|---|---|
| 3,207,058 | 9/1965 | Gaylord | 98/115 R |
| 3,653,443 | 4/1972 | Dockery | 169/65 |
| 3,772,499 | 11/1973 | Fritzsche | 169/65 |
| 3,785,124 | 1/1974 | Gaylord | 55/118 |
| 3,866,687 | 2/1975 | Banner | 169/65 |
| 3,993,138 | 11/1976 | Stevens et al. | 169/61 |
| 4,027,302 | 5/1977 | Healey et al. | 169/61 |

*Primary Examiner*—Joseph J. Rolla
*Assistant Examiner*—Kenneth Noland
*Attorney, Agent, or Firm*—Lee R. Schermerhorn

[57] ABSTRACT

A water spray system applied directly to cooking units in a kitchen rather than to the ventilating duct for the cooking units. The system may be a wet system with water pressure maintained at spray nozzles which open in case of fire, or an open head, or dry, system controlled by thermostats and a solenoid water valve. Safeguards are provided against loss of water pressure, surges in the water supply line, flare ups after partial cooling of the thermostats, closing of a solenoid gas valve supplying gas burners in the cooking units as a result of momentary outages in the electric service supplying the control circuits, and other contingencies.

17 Claims, 15 Drawing Figures

216
215
7
8
218
9
226
219
217
213
212
221
51, 251
52, 73
222
223
225
224
220
228
51, 52
210

WATER SPRAY FIRE PROTECTION FOR HOODS OVER COOKING UNITS

BACKGROUND OF THE INVENTION

This invention relates to a water spray or sprinkler system for fire protection of cooking equipment in a kitchen.

Much work has been done on fire protection systems incorporated in kitchen exhaust hoods. When the ventilators system is not equipped with grease extractors, grease condenses from the fumes of the hot cooking equipment and adheres to the inside walls of the ventilating duct. When the ventilator is equipped with grease extracting baffles or filters the grease deposits are largely concentrated in those areas. This fire hazard has long been recognized and many types of fire extinguishing systems have been proposed and adapted to cope with the problem of fires in the ventilators.

Very little attention has been directed, however, to the application of fire protection equipment directly to the cooking equipment itself so that fires may be extinguished where they originate, before they reach the grease deposits in the ventilator.

SUMMARY OF THE INVENTION

The present invention is directed to fire protection for the cooking equipment itself, to extinguish a fire at its source regardless of whether or not the ventilator contains its own fire protection devices. The present systems are entirely independent of any fire protection equipment which may be incorporated in the ventilator.

In the present systems water spray nozzles are mounted in the ventilating hood entirely outside of the ventilating duct and directed downward towards the various cooking units under the hood. Controls are mounted in a cabinet in an accessible position out of the fire zone. Visual and audible alarms warn of fire condition on the cooking units. Warning means are provided to respond to loss of adequate water pressure in the sprinkler system. In the event of fire on the cooking units electricity and gas supplies to the cooking units are shut off. In the event of a water surge in the plumbing system of the building a time delay relay prevents premature shut down of the cooking equipment.

Two different types of fire protection systems are illustrated and described. One is a so-called wet system wherein water pressure is maintained at all times at the spray nozzles directed toward the cooking units. These nozzles are individually actuated in response to elevated temperature at the nozzle to open that particular nozzle and release a water spray.

The second system is designated as an open head system or dry system wherein the water supply is turned on by a solenoid valve in a piping system supplying all of the sprinkler nozzles, in response to elevated temperature at one or more thermostats mounted in the ventilator hood over the cooking units.

The invention will be better understood and additional objects and advantages will become apparent from the following description of the preferred embodiments illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENTS

Embodiment in FIGS. 1–8

Figure 1:
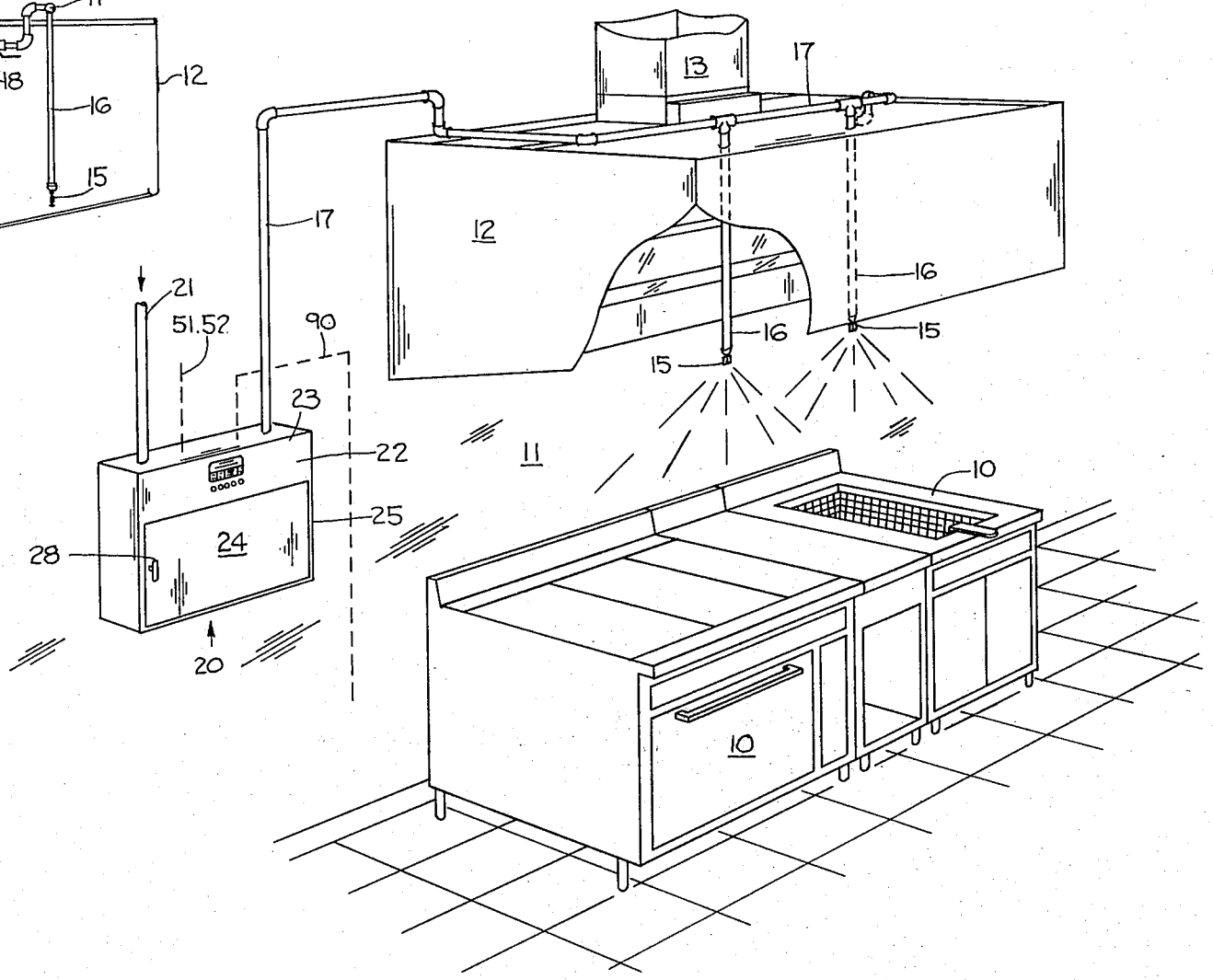
FIG. 1 is a perspective view of a first embodiment showing the wet system of the invention applied to a ventilating hood over a plurality of cooking units.

FIG. 1 illustrates a typical restaurant kitchen having a plurality of cooking units 10 positioned against a backwall 11. In such a typical installation some of the cooking units 10 are heated by gas and others are heated by electricity. Overhanging the cooking units 10 is a ventilator hood 12 to capture the steam, smoke and fumes generated by the cooking processes and discharge them through an exhaust duct 13 equipped with an exhaust fan, not shown.

FIG. 1, by way of example, illustrates a wall type installation wherein the hood 12 is mounted on the backwall 11 of the kitchen but the present invention may also be applied to an island type installation wherein the cooking units 10 and hood 12 are spaced away from the kitchen wall.

The fire protection system comprises spray nozzles 15 on the lower ends of water pipes 16 connected with a water supply pipe 17. Supply pipe 17 is supported on top of hood 12 and the vertical pipes 16 project downward within the hood to place the nozzles 15 a short distance above the cooking units 10.

This is what is known as a wet system wherein water pressure is maintained at all times in the pipes 16 and 17. The nozzles 15 are a conventional type similar to those used in building sprinkler systems wherein the water is released through the nozzle by expanding a liquid in a frangible quartz glass container in the nozzle in response to an elevated temperature of predetermined value at the position of the nozzle.

Figure 1A:
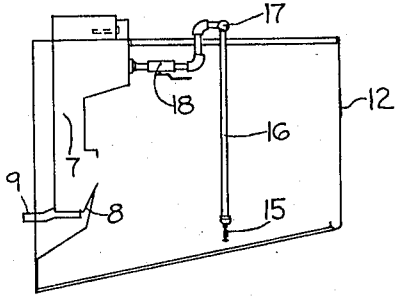
FIG. 1A is an enlarged perspective view in section of a portion of FIG. 1.

Supply pipe 17 is connected to a hand valve 18 in FIG. 1A which may be opened for flow test. The water in a flow test is discharged into ventilator 7 and carried away by a bottom trough 8 and drain pipe 9.

Supply pipe 17 extends from a control cabinet 20 mounted, for example, on backwall 11 in an accessible position at a safe distance from cooking units 10 and hood 12. Also extending from control cabinet 20 is an input water supply pipe 21 from the building water supply system. Control cabinet 20 has an upper door 22 hinged at its upper edge 23 and a lower door 24 hinged at its right edge 25 and equipped with a handle 28.

Figure 2:
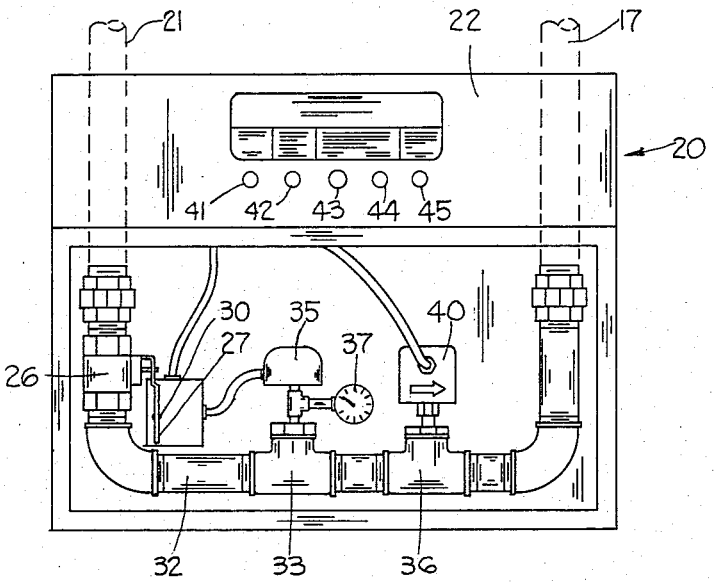
FIG. 2 is a front elevation view of the control cabinet in FIG. 1 with the lower door removed.
Figure 3:
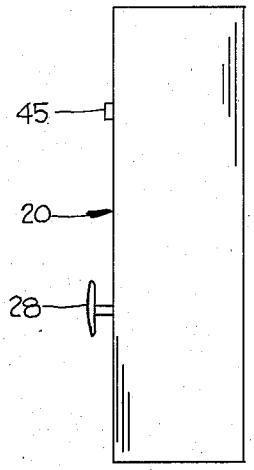
FIG. 3 is an end elevation view of the control cabinet in FIG. 2.

In FIG. 2 the upper door 22 of control cabinet 20 is shown in closed position and the lower door 24 has been omitted in the drawing to shown the interior of the lower portion of the cabinet. Inlet pipe 21 is connected to a hand valve 26 having a long handle 27. In the normally open position of the valve, handle 27 extends downward and bears against the actuating button of an electric switch 30 to hold the switch in a normally closed position.

Figure 4:
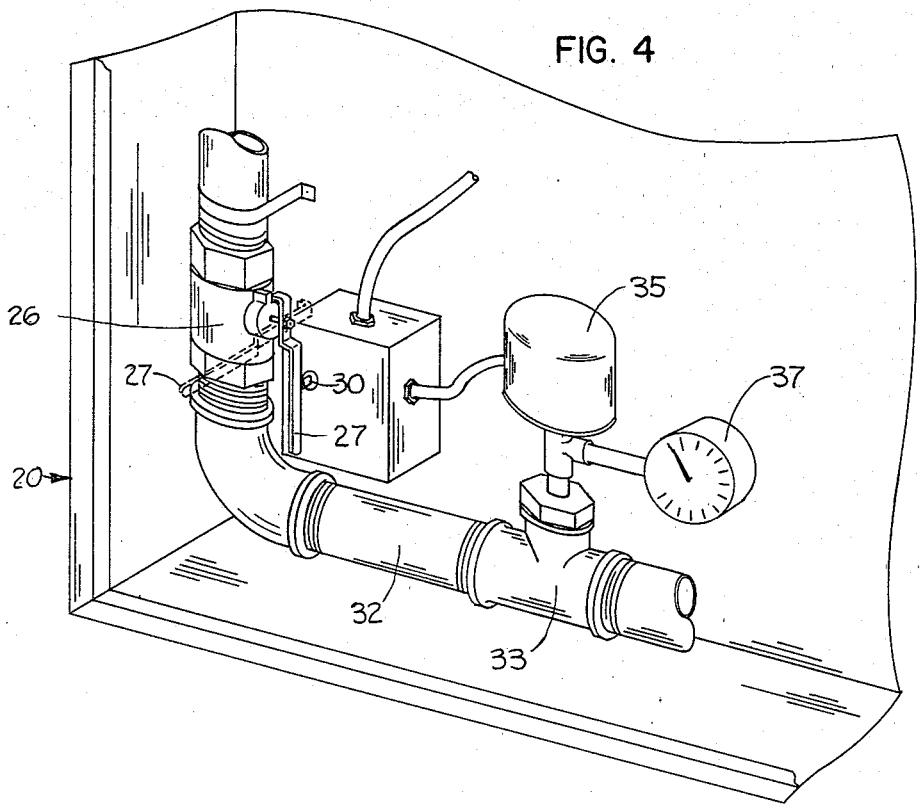
FIG. 4 is a fragmentary perspective view of a lower portion of the control cabinet in FIG. 2.

Valve 26 may be closed by turning handle 27 outward 90° clockwise to horizontal position as shown in broken lines in FIG. 4. This releases switch 30 for spring actuation to open circuit position and causes the end of the handle to project forward through the door opening so that door 24 in FIG. 1 cannot be closed when the inlet water supply is manually shut off. This provides a warning that the sprinkler system in FIG. 1 is inoperative as long as the valve handle 27 is in a position to prevent closing the cabinet door 24.

When hand valve 26 is open, inlet water pressure is transmitted through a pipe connection 32 to a pipe fitting 33 equipped with a pressure switch 35 and pressure gauge 37. Connected between pressure switch pipe fitting 33 and supply pipe 17 is a pipe fitting 36 equipped with a flow switch 40 which is normally closed when there is no flow of water through supply pipe 17.

Figure 5:
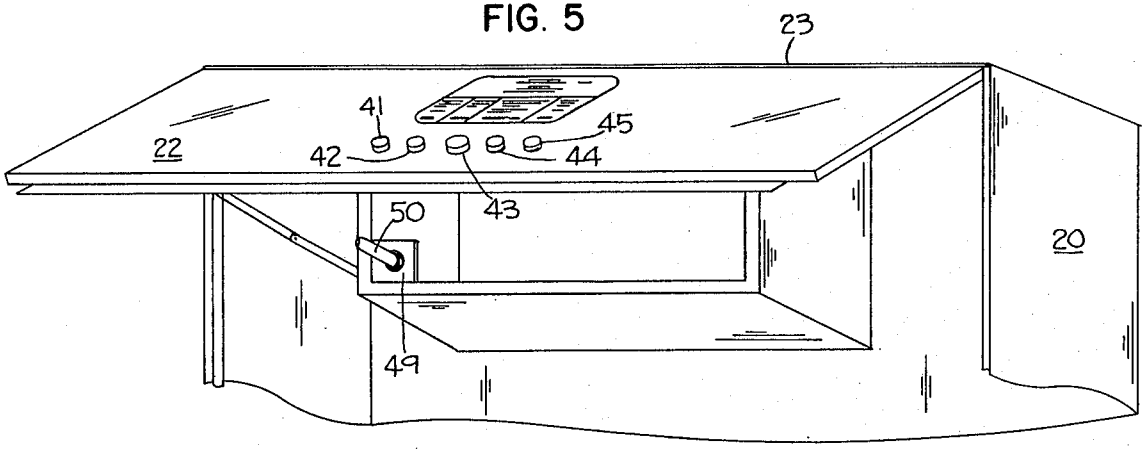
FIG. 5 is a fragmentary perspective view of the upper portion of the control cabinet in FIG. 2 showing the upper door in open position.

As shown in FIGS. 2 and 5 the upper door 22 carries a row of signal devices 41–45. Numeral 41 designates a "system operational" green indicator light and numeral 42 designates a "system not operational" amber indicator light. Numeral 43 designates a "fire alert alarm" audible signal. Numeral 44 designates a "fire alert indicator" red indicator light. Numeral 45 designates a "fuel shut-off reset" having a switch button with a red light.

Figure 6:
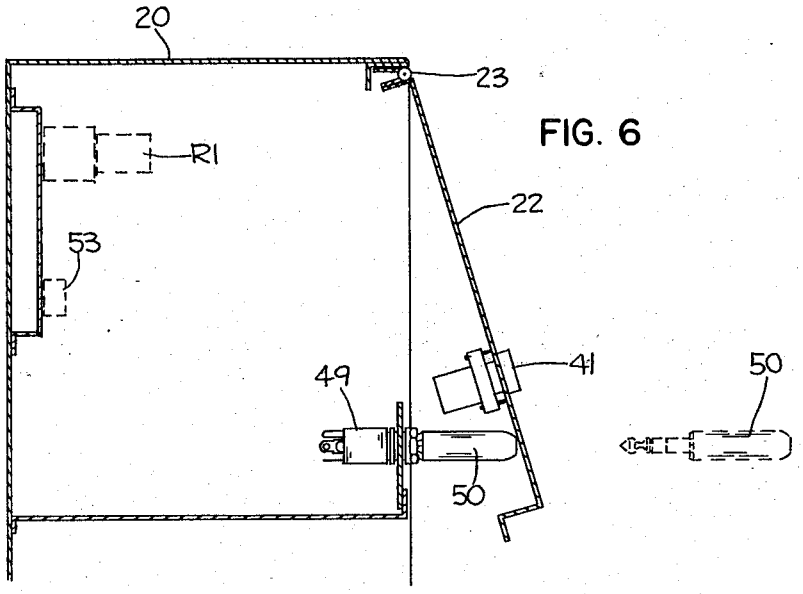
FIG. 6 is sectional view of the upper portion of the control cabinet shown in FIG. 5.

FIGS. 5 and 6 show an electric jack or receptacle 49 to receive a plug type test switch 50. In normal operation the plug 50 is removed as shown in broken lines in FIG. 5 and the door 22 closes over the jack 49. For test purposes the plug 50 is inserted in jack 49 as shown in solid lines and in this position the plug protrudes to hold door 22 partially open as a warning that the fire protection system is not fully operational during the test. The functions of the various elements mentioned in FIGS. 2–6 will be described below.

Figure 7:
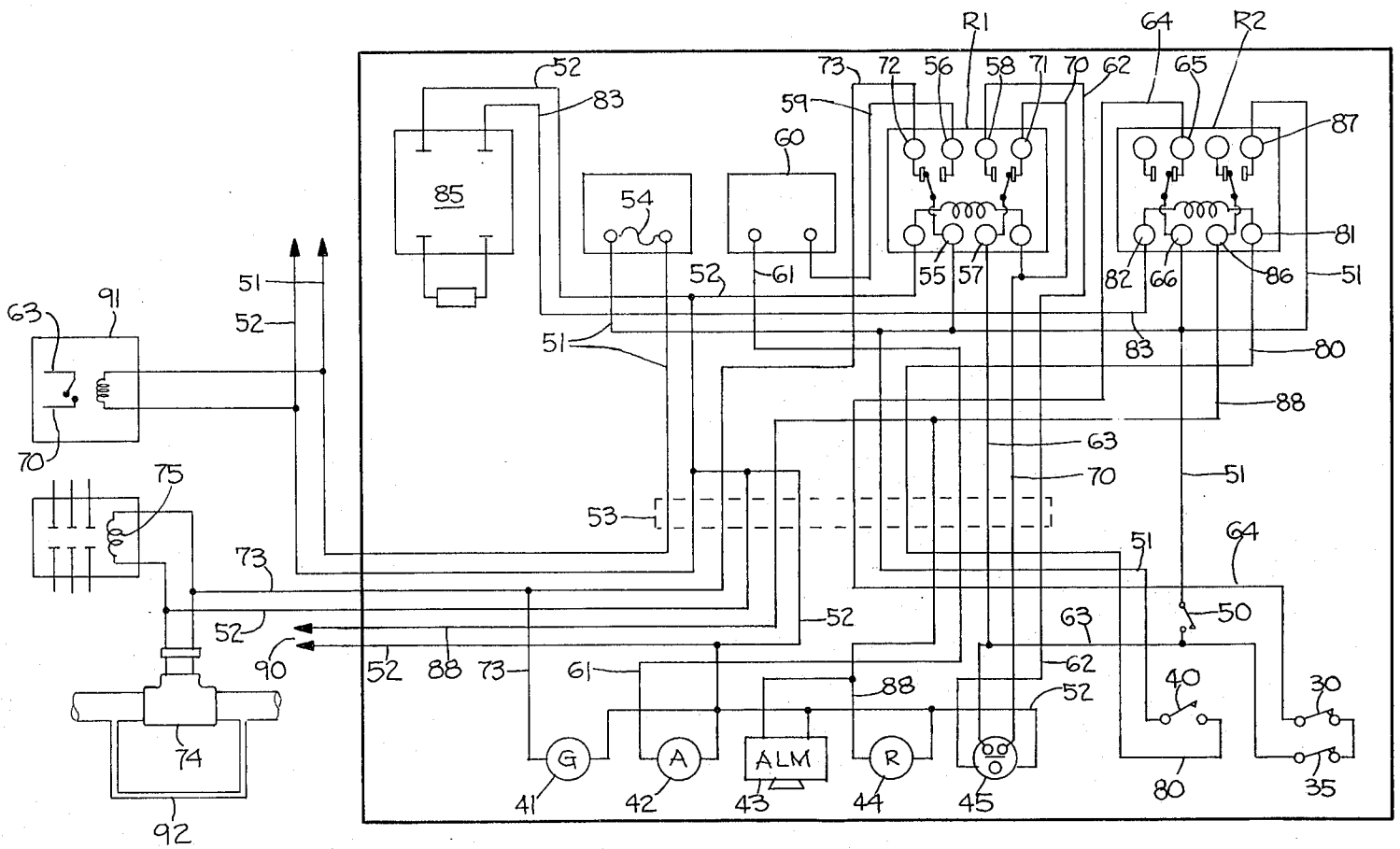
FIG. 7 is a wiring diagram of the control system for the fire protection system shown in FIGS. 1–6.

On FIG. 7 power is supplied by line wires 51 and 52 through terminal block 53 and a fuse 54. The system is shown in normal operating condition with relay R1 energized and relay R2 de-energized.

Thus, before starting up the system, before relay R1 has been energized, the relay contacts in relay R1 connect terminal 55 with terminal 56 and connect terminal 57 with terminal 58. Line wire 51 is thereby connected through wire 59 with flasher 60, this circuit being completed through wire 61, amber light 42 back to line wire 52 causing amber light 42 to flash on and off, indicating that the system is not in operating mode. Flasher 60 is a conventional unit which does not require detailed description.

At this time, reset light 45 is energized through wire 62, terminals 58 and 57 of relay R1, wire 63, pressure switch 35 and valve switch 30, assuming these switches to be closed, wire 64, and terminals 65 and 66 of relay R2 which are connected together by a normally closed relay contact, back to line wire 51.

The energized reset light indicates that reset button 45 can be pressed to place the system in operational mode. Momentary contact of the reset button energizes relay R1 and establishes a holding circuit for the relay coil in relay R1, one one side of which is connected to line wire 52.

The momentary contact of reset button 45 completes the energizing circuit of relay R1 through wire 70, reset button 45, wire 63, closed switches 35 and 30, wire 64 and terminals 65 and 66 in relay R2 back to line wire 51. This shifts relay R1 to the position shown, which establishes a holding circuit through wire 70, relay terminals 71 and 57 which are now connected together, wire 63, closed switches 35 and 30, wire 64 and terminals 65 and 66 in relay R2 back to line wire 51.

Energization of relay R1 breaks the circuits at terminals 56 and 58 stopping the flasher 60 and turning off amber light 42 and reset light 45. Power from terminal 72 and line 51 then energizes green light 41 through wire 73. Power from wire 73 also energizes gas solenoid valve 74 and electrical contactor holding coil 75 for operating the gas and electric cooking units 10 in FIG. 1. The control system is now in the operational mode, the only energized signal light being green light 41. Relay R1 is energized and relay R2 is de-energized as shown.

Low water pressure will open pressure switch 35, breaking the holding circuit for relay R1, its de-energization turning off green light 41, gas valve 74 and contactor 75 and energizing flasher 60 to flash amber light 42.

When a fire associated with any of the cooking units 10 actuates one of more of the spray nozzles 15, water begins to flow through the fire extinguishing system causing the normally open flow switch 40 to close. This closes a circuit from line wire 51 through wire 80, terminals 81 and 82 and the energizing coil of relay R2 and wire 83 to time delay relay 85.

A brief delay of five seconds, for example, then occurs before relay 82 is energized and at that time a contact in relay R2 connects terminal 86 with terminal 87. This connects line wire 51 with wire 88 to energize the audio alarm 43, red light 44 and an optional signal system 90 such as building fire alarm system, monitoring system, etc.

At the same time, a contact in relay R2 breaks the circuit between terminals 66 and 65, breaking the holding circuit through wire 64 fo relay R1. The de-energization of relay R1 turns off green light 41 and de-energizes gas solenoid valve 74 and the electrical contactor holding coil 75.

When the fire is extinguished, the water is shut off by hand valve 26 in FIG. 4 opening the holding circuit for relay R1 at switch 30 and returning flow switch 40 to open position, opening the circuit through wire 80 and de-energizing relay R2. This turns off alarm 43 and red light 44.

The open nozzle 15 is replaced with a new one of correct degree setting and the spray system is recharged by turning the hand valve 26 in FIG. 4 to full open position re-closing switch 30. Then when reset button 45 is pressed, relay R1 is energized, the amber light 42 will go off, the green light 41 will turn on and the gas and electricity will be restored at 74, 75 for the cooking equipment.

Hand valve 27 is straight down in solid line position in FIG. 4 when the valve is open. When this valve is closed as above described the handle is turned 90° clockwise to its broken line position preventing closing of the door 24 (FIG. 1) on the control cabinet 20. This provides a warning that the water is not turned on. This is in addition to the safeguard provided by valve switch 30 which prevents putting the system in operational mode as described above. Pressure switch 35 prevents putting the system in operational mode if the water pressure is too low.

Time delay relay 85 prevents false alarms and shut downs from mere momentary surges of water pressure as by the sudden opening of valves or the flushing of toilets in the building. Flow switch 40 is sensitive to such surges. A preferred time delay relay for this purpose is Series MMS manufactured by Amnetics in Syracuse, N.Y. It is designated as a delay on make type of relay. A preferred flow switch 40 is model FS4-3 or FS7-4 manufactured by McDonnell and Miller Fluid Handling Division of International Telephone and Telegraph Company in Chicago, Ill.

Unnecessary shut off of the gas supply from time to time is more than a mere annoyance to cooks in the kitchen. Many such kitchens have numerous gas burners which are often somewhat difficult to relight after a shut down by the closing of gas valve 74. If not relighted promptly by hand when the gas valve re-opens, raw gas will flow out into the kitchen because most such gas equipment does not have automatic relight devices.

Certain options may be added to improve the system thus far described. Momentary power outages in line wires 51 and 52 can cause gas valve 74 to close and thus result in similar annoyance involving gas burners and the necessary relighting thereof following restoration of power.

To alleviate this problem, with momentary power outages only, i.e. a few seconds, a "delay on break" time delay relay 91 is employed to automatically re-energize relay R1 upon restoration of power within an established time period. Relay 91 responds to power loss in line wires 51 and 52 to close a momentary connection between wires 63 and 70 from reset switch 45. This restores power to re-open solenoid gas valve 74 without manually pressing the push button on reset switch 45.

A preferred form of time delay relay for this purpose is the Agastat 7000 series "off-delay" model manufactured by Amerace Corporation, Control Products Division, in Union, N.J.

With this option a slow closing or delayed closing (upon de-energizing) valve 74 is used, which provides gas flow sufficient to maintain the gas pilot lights operating during the momentary power outage.

Another option is to provide a small bypass pipe 92 around valve 74 to operate the pilot lights without a time limitation. This option may be used with or without the first option described above.

By pass test switch 50 in FIGS. 6 and 7 is used to test the fire mode circuit only. When this switch is closed by inserting the plug 50 in socket 49 in FIG. 6 power is applied to the terminal 57 in relay R1 to maintain the holding circuit for the relay. This allows the fire mode circuit to be tested by, in effect, closing the flow switch 40 manually without turning off the gas or electricity for the cooking equipment at 74, 75. When switch plug 50 is in position as shown in solid lines in FIG. 6 it prevents closing of the upper door 22 on cabinet 20 as a warning that testing is in progress.

Embodiment in FIGS. 8–14

Figures 8, 9, 10:
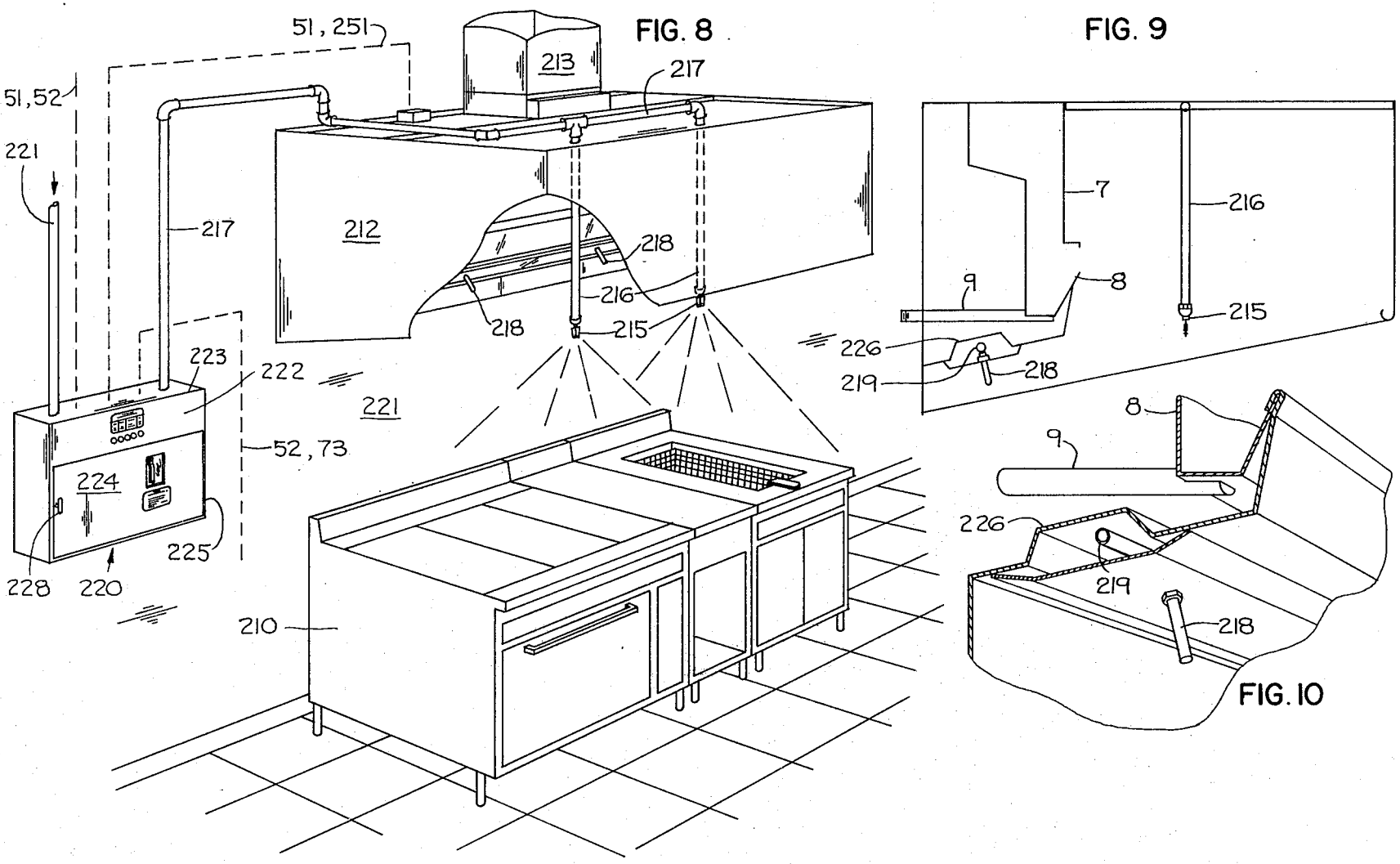
FIG. 8 is a perspective view similar to FIG. 1 showing the open head or dry system as a second embodiment of the invention.
FIG. 9 is a fragmentary enlarged perspective view of a portion of FIG. 8.
FIG. 10 is an enlarged fragmentary perspective view of a portion of FIG. 9.

FIG. 8 illustrates a typical restaurant kitchen having a plurality of cooking units 210 positioned against a backwall 211. In such a typical installation some of the cooking units 210 are heated by gas and others are heated by electricity. Overhanging the cooking units 210 is a ventilator hood 212 to capture the steam, smoke and fumes generated by the cooking processes and discharge them through an exhaust duct 213 equipped with an exhaust fan, not shown.

FIG. 8 illustrates a wall type installation wherein the hood 212 is mounted on the backwall 211 of the kitchen but the present invention may also be applied to an island type installation wherein the cooking units 210 and hood 212 are spaced away from the kitchen wall.

The fire protection system comprises spray nozzles 215 on the lower ends of water pipes 216 connected with a water supply pipe 217. Supply pipe 217 is supported on top of hood 212 and the vertical pipes 216 project downward within the hood to place the nozzle 215 a short distance above the cooking units 210.

This is an open head system sometimes referred to as a dry type system i.e. the nozzles 215 are open and actuation is accomplished by one or more thermostats 218 which when activated by a fire on cooking units 210 will energize a solenoid valve to release the water. Upon activation, all nozzles in the system will discharge and water will remain running for as long as the temperature of the activated thermostat is above the set point. When the temperature of the activated thermostat drops below its set point the water will continue to flow for the time set on a time delay relay and then shut off.

Thermostats 218 are connected to an electrical conduit 219 extending through a raceway 226 under the ventilator trough 8 so that the thermostats can be shifted along the raceway if the cooking units 210 are moved along wall 211.

Supply pipe 217 extends from a control cabinet 220 mounted, for example, on backwall 211 in an accessible position at a safe distance from cooking units 210 and hood 212. Also extending from control cabinet 220 is an input water supply pipe 221. Control cabinet 220 has an upper door 222 hinged at its upper edge 223 and a lower door 224 hinged at its right edge 225 and equipped with a handle 228.

Figure 12:
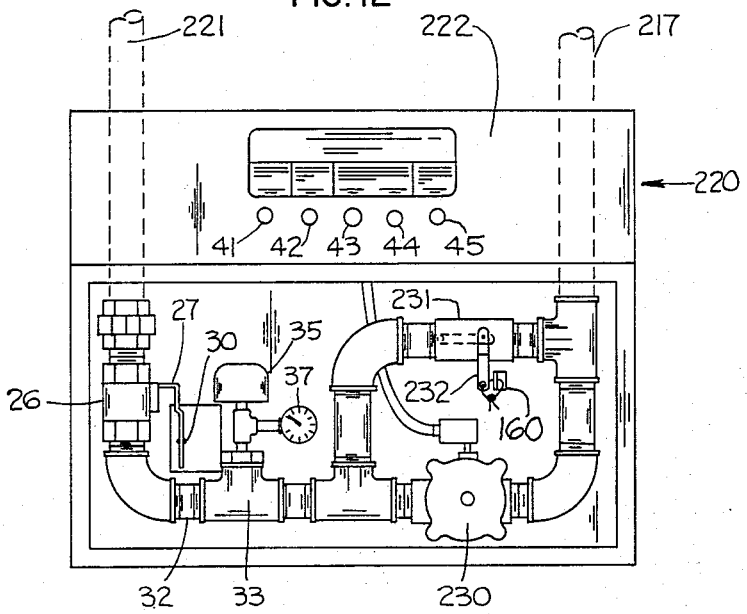
FIG. 12 is a front elevation view of the control cabinet in FIG. 11 with the lower door removed.
Figure 13:
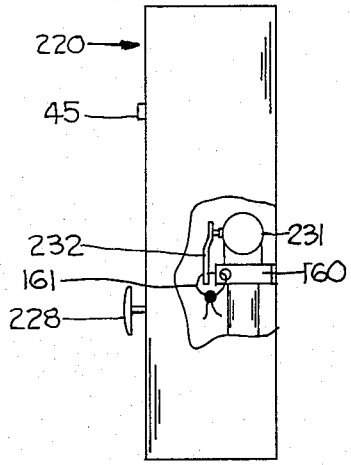
FIG. 13 is an end elevation view of the control cabinet in FIGS. 11 and 12.

In FIG. 12 the upper door 222 of control cabinet 220 is shown in closed position and the lower door 224 has been omitted in the drawing to show the interior of the cabinet. Inlet pipe 221 is connected to hand valve 26 having a long handle 27. In the normally open position of the valve, handle 27 extends downward and bears against the actuating button of an electric switch 30 to hold the switch in a normally closed position.

Valve 26 may be closed by turning handle 27 outward to horizontal position as shown in broken lines in FIG. 4. This releases switch 30 for spring actuation to open circuit position and causes the end of the handle to project forward through the door opening so that the door 224 in FIG. 8 cannot be closed when the inlet water supply is shut off. This provides a warning that the sprinkler system in FIG. 8 is inoperative as long as the valve handle 27 is in position to prevent closing of the cabinet door 224.

When hand valve 26 is open, inlet water pressure from pipe 221 is transmitted through a pipe connection 32 to a pipe fitting 33 equipped with a pressure switch 35. Connected between pressure switch pipe fitting 33 and supply pipe 217 is a solenoid valve 230.

An emergency by-pass hand valve 231 is visible through the glass window 233 and is connected in shunt circuit around the solenoid valve 230.

Handle 232 on hand valve 231 has a sealed tie wire 161 closing the valve in sealed, locked position. For emergency by-pass operation sealed the wire 161 is easily broken away from handle 232 and mounting bracket 160.

Figure 11:
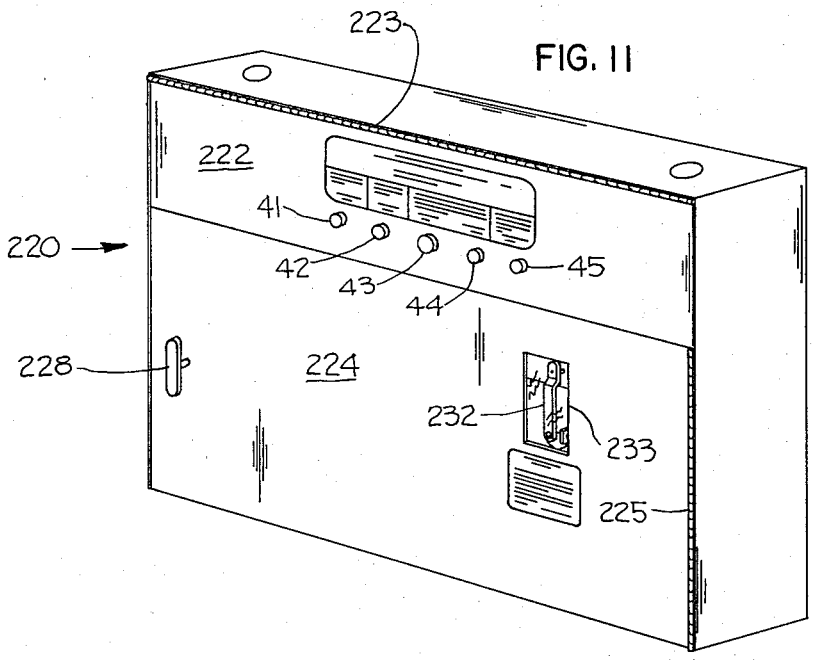
FIG. 11 is a perspective view of the control cabinet in FIG. 8.

As shown in FIGS. 11 and 12, the upper door 222 carries a row of signal devices 41–45. Numeral 41 designates a "system operational" green indicator light and numeral 42 designates a "system not operational" amber indicator light. Numeral 43 designates a "fire alert alarm" audible signal. Numeral 44 designates a "fire alert indicator" red indicator light. Numeral 45 designates a "fuel shut-off reset" reset switch button with a red light.

The upper compartment in cabinet 220 also contains a jack or socket 49 to receive a plug type test switch 50 as described in connection with FIGS. 5 and 6.

Figure 14:
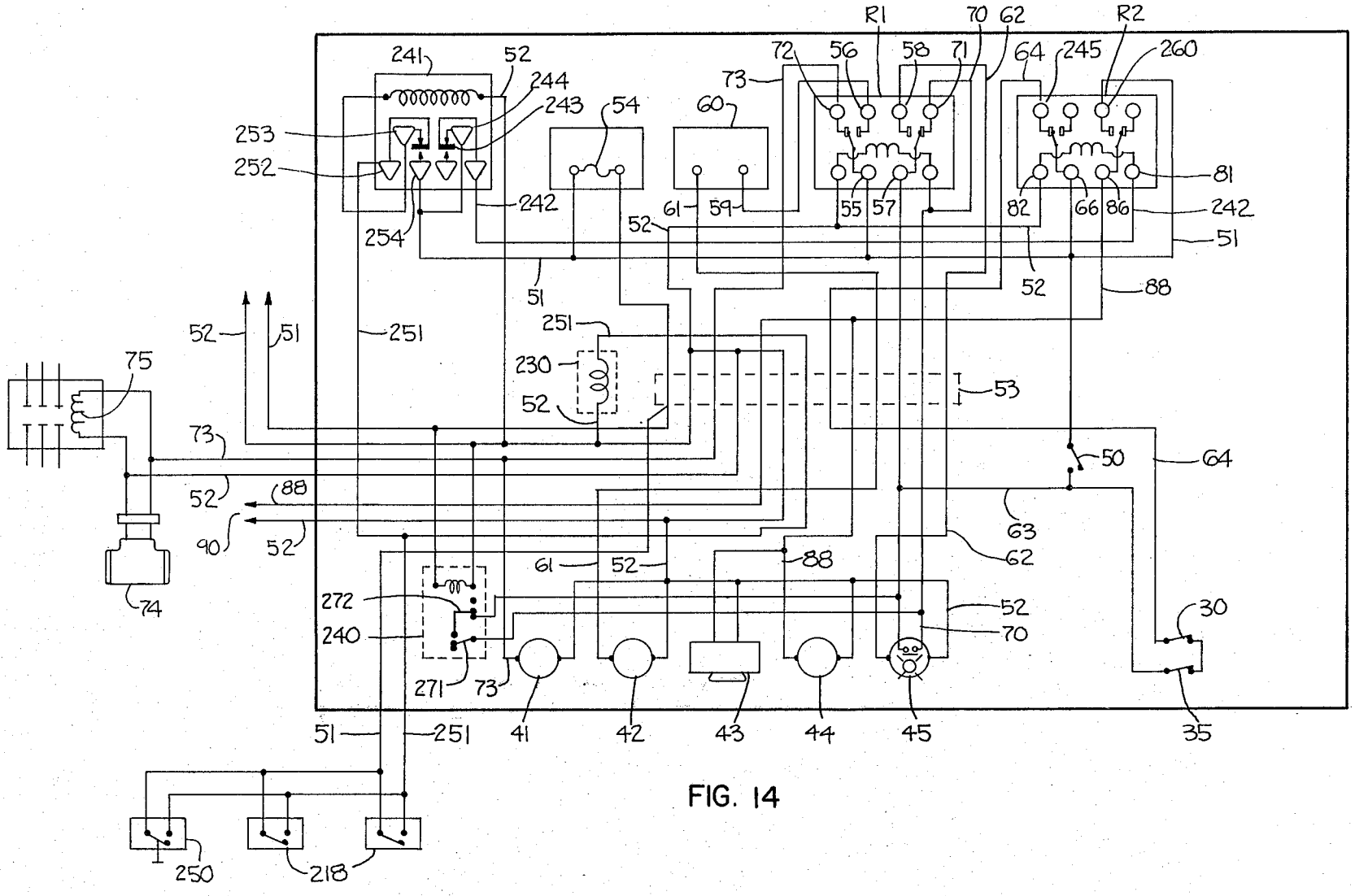
FIG. 14 is a wiring diagram of the control system for the fire protection system shown in FIGS. 8–13.

Elements and circuit connections in FIG. 14 which are common to those in FIG. 7 are identified by the same reference numerals and reference is made to the description of FIG. 7 for a more detailed description of these common features. Relays R1 and R2 are shown in operational mode.

Certain circuits in FIG. 14 are energized before the system is made operational. Power lines 51, 52 directly energize power interruption reset time delay relay 240. Relay R2 is energized through normally closed contacts in time delay relay 241. One end of the coil in relay R2 is connected directly to power line 52 through terminal 82 and the other end of the coil is connected through terminal 81 to power line 51 through wire 242, normally closed time delay relay contact 243 and terminal 244. Energization of relay R2 places its contacts in the positions shown.

This position of the contacts in relay R2 connects line wire 51 with relay terminal 245, making a circuit through wire 64, valve switch 30, pressure switch 35, and wire 63 to reset button light 45.

De-energized relay R1 makes a circuit from line wire 51 through terminal 55 relay contact and terminal 56, wire 59, flasher 60, wire 61 to energize amber light 42. Amber light 42 will be flashing at this time and the light in reset button 45 will be on, the later being energized through the circuit in the light from line wire 52 through wire 62, relay R1 terminal 58, terminal 57, wire 63, pressure switch 35, valve switch 30, wire 64, relay R2 terminal 245 and contact to terminal 66 and line wire 51.

Thus, prior to the operational mode, relay R1, green light 41, alarm 43, red light 44, gas valve 74, electric contactor 75 and water solenoid valve 230 are de-energized and relay R2, amber light 42, flasher 60 and reset button light at 45 are energized.

Pressing reset button 45 places the system in operational mode. When this is done a circuit is completed from line wire 52 through the R1 relay coil to wire 70, pushbutton switch 45, wire 63, pressure switch 35 valve switch 30, wire 64 and relay R2 back to line wire 51 to energize relay R1. This places the movable contacts in relay R1 in the positions shown in FIG. 14.

The energization of relay R1 establishes a holding circuit to hold the relay in energized position and opens the circuit to the reset light at 45, at the same time breaking the circuit to flasher 60 and amber light 42, energizing green light 41 and energizing solenoid gas valve 74 and electrical contactor 75, as previously described in connection with FIG. 7. Both relays R1 and R2 are now energized, as show in FIG. 14.

In case of fire on the cooking units, one or more of thermostats 218 or remote manual fire switch 250 will be closed. This closes a circuit through wire 251 and water solenoid valve 230 back to supply wire 52 to open the valve and release water through all the spray nozzles 215.

At the same time, a circuit is also closed through wire 251, and terminals 252, 253 and the solenoid coil of time delay relay 241 back to line wire 52 to energize the time delay relay. This shifts the relay contacts to connect terminal 252 with terminal 254 and break the connection between terminals 244 and 255, the latter opening the circuit to wire 242 and de-energizing relay R2 at terminal 81.

The de-energization of relay R2 connects wire 88 and terminal 86 with terminal 260 and line wire 51 to energize alarm 43 and red light 44 and optional fire alarm circuit 90 to warn that a fire exists.

At the same time, the circuit is broken between terminal 66 and terminal 245 to open the circuit through wire 64, switches 30 and 35, wire 63, terminals 57 and 71 of relay R1 and wire 70 to de-energize relay R1 by breaking is holding circuit.

The de-energization of relay R1 breaks the circuit between terminals 55 and 72 de-energizing wire 73 and turning off green light 41, gas valve 74 and electrical contactor 75. Terminal 55 is connected to terminal 56 energizing wire 59 and flasher 60 causing amber light 42 to flash.

Water continues to discharge from spray nozzles 215 until the fire is out and the temperature drops below the setting of the actuated thermostat. Adjustable time delay relay 241 maintains the flow of water for a time interval such as approximately 20 seconds longer to prevent flare ups and cycling of the water.

The shifting of the movable contacts in time delay relay 241 when the relay solenoid is energized breaks the solenoid circuit between terminals 252 and 253 to immediately de-energize the solenoid. This is a pneumatic action type relay wherein the movable contacts are held in actuated position by an air pressure device to maintain an electrical circuit between terminals 252 and 254 for the stated delay interval of approximately 20 seconds after which the movable contacts return to the upper position as shown.

If the thermostatic switches 218 or remote fire switch 250 are still closed they maintain energization of solenoid valve 230 to continue the flow of water and the time delay relay solenoid coil 241 is re-energized in repeated cycles as long as the fire is active.

When all of the closed switches 218 and 250 have re-opened, time delay relay 241 maintains an energizing circuit for solenoid valve 230 through wire 251, terminal 252 and terminal 254 during the twenty second delay interval. Then when the movable contacts in the time delay relay return to their upper positions the relay is not re-energized because its circuit is open at switches 218 and 250.

When the fire is out and the 20 second time delay has elapsed, terminal 255 is again connected to terminal 244 to re-energize relay R2 through wire 242. The circuit for alarm 43 and red light 44 is broken between terminals 86 and 260 by movement of the movable contacts to the positions shown and the circuit to reset button light 45 is re-established through the movable contact between terminals 66 and 245. The reset procedure for returning the system to operational mode is as described above.

A preferred time delay relay having the described characteristics is the Agastat 7000 series "off-delay" model manufactured by Amerace Corporation, Control Products Division, in Union, N.J.

When momentary power failure or power interruption occurs in supply lines 51, 52 the power interruption reset time delay relay 240 provides a shunt circuit around the reset button 45 for a brief interval such as 10 seconds allowing the solenoid gas valve 74 to be automatically reset if power resumes within the 10 second interval.

Meanwhile, the gas valve will remain essentially open during this period due to the slow closing feature of the gas valve. The valve will return to full open position if power is restored within 10 seconds or will close completely turning the gas off when power interruption is longer than 10 seconds. This valve is a spring return motorized valve with a 15 second closing time. The combination of relay 240 and gas valve 74 avoids the tedious chore of re-lighting numerous gas burners in the cooking units every time there is a brief electrical power interruption, as frequently occurs in some regions.

In time delay relay 240, upon power interruption in supply lines 51 and 52, contact 271 is raised to shunt the reset switch 45. If power is restored within the 10 second interval, gas valve 74 is still partially open to maintain operation of the gas burners and the electrical system in FIG. 14 is automatically restored to operational mode the same as if reset button 45 were pressed manually. If power is not restored within the 10 second interval, contact 272 is raised to open the shunt circuit and gas valve 74 closes completely in 15 seconds. Then the system must be put in operational mode by reset switch 45 as described above and the gas burners re-lighted, after restoration of power. Restoration of power returns contacts 271 and 272 to their normal positions shown.

A preferred form of relay 240 having the described characteristics is an electro-pneumatic Agastat Series 7022AC "off delay" with instant transfer auxiliary switch, manufactured by Amerace Corporation, Control Products Division, in Union, N.J.

What is claimed is:

1. A fire protection system for hoods over cooking units comprising a water spray nozzle under the hood arranged to spray water downward toward said cooking units, a hand valve for turning off the water supply for said spray nozzle; a normally energized operating condition signal light, a system not operational signal light, a fire condition signal light and audible alarm; fire responsive means under said hood arranged to respond to a fire on said cooking units and actuate said spray nozzle; means responsive to the operation of said spray nozzle to turn off both said operating condition signal light and an energy supply for said cooking units and turn on said fire condition signal light and audible alarm; and a manual reset switch arranged to turn on said operating condition signal light and said energy supply for said cooking units and turn off said fire condition signal light and audible alarm, a valve switch actuated by turning said hand valve to off position and a water pressure switch actuated by low pressure in said water pressure system; and means operated by said actuation of said valve switch or pressure switch to turn off said operating condition signal light and said energy supply for said cooking units, turn on said audible alarm and flash said system not operational signal light on and off continuously, a manual bypass test switch arranged to make said valve switch and water pressure switch ineffective, said signal lights, test switch and hand valve being mounted in a cabinet having normally closed doors, said test switch and valve being arranged to prevent the closing of said doors when said test switch is in test position and said valve is in closed position.

2. A system as defined in claim 1 including a signal light in said reset switch, means controlled by said valve switch and water pressure switch to turn off said reset switch signal light when said water supply is turned off or at low pressure and turn on said reset switch signal light when said water supply and pressure have been established.

3. A system as defined in claim 1, said fire responsive means comprising a temperature responsive link in said water spray nozzle arranged to open said nozzle to discharge said water spray; said means responsive to the operation of said spray nozzle comprising a flow switch actuated by the flow of water in said water pressure system.

4. A system as defined in claim 3 including a time delay relay arranged to delay for a brief interval said turning off of said operating condition signal light and said energy supply for said cooking units and said turning on of said fire' condition signal light and audible alarm after said flow switch is actuated.

5. A system as defined in claim 1, said system being an open head system wherein said fire responsive means comprises a thermostat; a solenoid valve actuated by said thermostat to supply water to said nozzle; said means responsive to the operation of said spray nozzle comprising relay circuits controlled by said thermostat when said solenoid valve is actuated.

6. A system as defined in claim 5 including a time delay relay arranged to delay the closing of said solenoid valve by said thermostat after cessation of a fire condition.

7. A system as defined in claim 1, said operating condition signal light being a green light, said system not operational signal light being an amber light and said fire condition signal light being a red light.

8. A fire protection system for cooking equipment comprising a water spray nozzle arranged to spray water on said equipment, a water pressure system arranged to supply said nozzle, fire responsive means arranged to respond to a fire on said cooking equipment and actuate said spray nozzle, means responsive to the operation of said spray nozzle to turn off an energy supply for said cooking equipment, a hand valve for turning off said water supply, a valve switch actuated by said hand valve, a pressure switch actuated by low pressure in said water supply, a reset switch arranged in a control system to restore said energy supply for said cooking equipment after the fire has been extinguished, and circuit means in said control system connected with said valve switch and pressure switch to prevent restoration of said energy supply for said cooking equipment while said hand valve is closed or low pressure exists in said water supply, a solenoid gas valve in a gas line supplying said energy for said cooking equipment, and a time delay relay continuously energized directly from the supply wires for said control system and arranged to shunt said reset switch for a short interval during a power interruption in said supply wires, to re-energize and re-open said solenoid valve if power is restored to said supply wires during said interval, said solenoid valve having a slow closing action to maintain a flow of gas to said cooking equipment during said interval.

9. A fire protection system as defined in claim 8 including a flow switch actuated by the flow of water to said nozzle to close said solenoid valve.

10. A fire protection system as defined in claim 9 including a time delay relay arranged to delay the closing of said valve for a brief interval so that momentary actuation of said flow switch by water surges in the source of water supply will not cause solenoid valve to close.

11. A fire protection system as defined in claim 8 said fire responsive means comprising a temperature responsive link in said water spray nozzle to open said nozzle to discharge said water spray.

12. A fire protection system as defined in claim 8 said system being a wet system wherein said fire responsive means comprises a thermostat, and a solenoid water valve controlled by said thermostat to actuate said spray nozzle.

13. A fire protectin system as defined in claim 12 including a time delay relay arranged to delay the closing of said water valve for a brief interval after the thermostat has cooled, to prevent flare ups and cycling of the water.

14. A fire protection system as defined in claim 12, said thermostat being mounted in a raceway so that the thermostat may be shifted along the raceway when the cooking equipment is moved.

15. A fire protection system as defined in claim 14, said raceway being mounted in a hood over the cooking equipment.

16. A fire protection system for cooking equipment comprising a water spray nozzle arranged to spray water on said equipment, a water pressure system arranged to supply said nozzle, fire responsive means arranged to respond to a fire on said cooking equipment and actuate said spray nozzle, means responsive to the operation of said spray nozzle to turn off an energy supply for said cooking equipment, a hand valve for turning off said water supply, a valve switch actuated by said hand valve, a pressure switch actuated by low pressure in said water supply, a reset switch arranged in a control system to restore said energy supply for said cooking equipment after the fire has been extinguished, and circuit means in said control system connected with said valve switch and pressure switch to prevent restoration of said energy supply for said cooking equipment while said hand valve is closed or low pressure exists in said water supply, a solenoid gas valve in a gas line supplying said energy for said cooking equipment, and a small bypass gas line around said solenoid valve to maintain a reduced flow of gas to gas burners in said cooking equipment during intervals when said solenoid valve is closed.

17. A fire protection system for cooking equipment comprising a water spray nozzle arranged to spray water on said equipment, a water pressure system arranged to supply said nozzle, fire responsive means arranged to respond to a fire on said cooking equipment and actuate said spray nozzle, means responsive to the operation of said spray nozzle to turn off an energy supply for said cooking equipment, a hand valve for turning off said water supply, a valve switch actuated by said hand valve, a pressure switch actuated by low pressure in said water supply, a reset switch arranged in a control system to restore said energy supply for said cooking equipment after the fire has been extinguished, circuit means in said control system connected with said valve switch and pressure switch to prevent restoration of said energy supply for said cooking equipment while said hand valve is closed or low pressure exists in said water supply, and a manual bypass test switch arranged to make said valve switch and water pressure switch ineffective, said test switch and hand valve being mounted in a cabinet having normally closed doors, said test switch and valve being arranged to prevent the closing of said doors when said test switch is in test position and said valve is in closed position.

* * * * *